US008189741B2

(12) United States Patent
Ernest et al.

(10) Patent No.: US 8,189,741 B2
(45) Date of Patent: May 29, 2012

(54) X-RAY TUBE ELECTRICAL POWER SUPPLY, ASSOCIATED POWER SUPPLY PROCESS AND IMAGING SYSTEM

(75) Inventors: Philippe Ernest, Buc (FR); Georges William Baptiste, Buc (FR)

(73) Assignee: General Electric Company, Schnectady, NY (US)

( * ) Notice: Subject to any disclaimer, the term of this patent is extended or adjusted under 35 U.S.C. 154(b) by 224 days.

(21) Appl. No.: 12/694,301

(22) Filed: Jan. 27, 2010

(65) Prior Publication Data

US 2010/0189225 A1 Jul. 29, 2010

(30) Foreign Application Priority Data

Jan. 28, 2009 (FR) ..... 09 50531

(51) Int. Cl.
*H05G 1/24* (2006.01)

(52) U.S. Cl. ..... 378/103

(58) Field of Classification Search ..... 378/101–119, 378/121

See application file for complete search history.

(56) References Cited

U.S. PATENT DOCUMENTS

| | | | | |
|---|---|---|---|---|
| 5,226,064 | A | 7/1993 | Yahata et al. | 378/4 |
| 5,305,363 | A | 4/1994 | Burke et al. | 378/4 |
| 2008/0112537 | A1 * | 5/2008 | Katcha et al. | 378/102 |

FOREIGN PATENT DOCUMENTS

WO 2008026127 A3 3/2008

* cited by examiner

*Primary Examiner* — Courtney Thomas

(74) *Attorney, Agent, or Firm* — Global Patent Operation; Jonathan E. Thomas

(57) ABSTRACT

An electrical power supply of an X-ray tube. A high voltage generation device having a primary capacitor is configured to transmit a high voltage to the X-ray tube. At least one voltage source is configured to supply the primary capacitor. An energy storage device has an auxiliary capacitor that is configured to receive from the primary capacitor a quantity of energy and to return said energy to the primary capacitor. A control device arranged in series between the high voltage generation device and the storage device is configured to connect or isolate the storage device from the high voltage generation device so the X-ray tube is powered by a variable high voltage very rapidly between a first high voltage and a second high voltage.

9 Claims, 5 Drawing Sheets

X-RAY TUBE ELECTRICAL POWER SUPPLY, ASSOCIATED POWER SUPPLY PROCESS AND IMAGING SYSTEM

CROSS-REFERENCE TO RELATED APPLICATIONS

This application claims priority under 35 U.S.C. §§119(a)-(d) or (f) to prior-filed, co-pending French patent application number 0950531, filed on Jan. 28, 2009, which is hereby incorporated by reference in its entirety.

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A SEQUENCE LISTING, A TABLE, OR COMPUTER PROGRAM LISTING APPENDIX SUBMITTED ON COMPACT DISC

Not Applicable

BACKGROUND OF THE INVENTION

1. Field of the Invention

The invention relates to medical imaging devices and more specifically to an electrical power supply of an X-ray tube and especially an electrical power supply of an X-ray computed tomography system.

It also relates to industrial applications, such as the X-ray checking of luggage in airports, enabling a differentiation of the density and the nature of the objects observed.

2. Description of Related Art

Computed Tomography (CT) is an X-ray medical imaging process which makes to possible, using a plurality of two-dimensional images (2D) acquired about an object or a patient to be imaged, to obtain a three-dimensional image (3D) of the object or the patient.

Throughout the acquisition, therefore at high frequencies (approximately 1 to 10 kHz), it is sometimes desirable to change the nature of the X-rays particularly to image a patient or an object in a contrasted manner.

As is known per se, the nature of the X-rays is particularly changed by modifying the power supply voltage of the X-ray tube between two levels named $kV^+$ and $kV^-$.

It must be possible to make such a change as quickly as possible by switching the power supply voltage of the X-ray tube rapidly from a first voltage to a second voltage. Such switching must for example be performed between 10 μs and 30 μs.

For example, for a switching time of 20 μs, this is equivalent to one tenth of the acquisition period, taking for example an acquisition frequency of 5 kHz.

However, the high voltage power supply of the X-ray tube comprises a filtering capacitor, whereto the parasitic capacitor $C_p$ of the high voltage cable is added (for a single-pole tube and per polarity in the case of a bipolar tube).

When said capacitor is discharged, by the current consumed by the tube, this results in a transition time from $kV^+$ to $kV^-$ depending on said current and which is frequently prohibitive.

For example, for voltages $kV^+$=140 kV and $kV^-$=80 kV, a capacitor is 500 pF, and the current consumed is 600 mA. The resultant transition time from $kV^+$ to $kV^-$ is equal to 50 μs.

In FIG. 1, a diagram illustrating the high voltage cable 10 is represented, wherein the entire high voltage capacitor has been symbolically allocated to $C_p$ (filtering capacitor plus parasitic capacitor), the X-ray tube 11, the power supply A supplying both high voltages $kV^+$ and $kV^-$.

If it is required to discharge said capacitor $C_p$ more rapidly than in the tube, this generates energy which needs to be dissipated. Recharging also requires that the generator return said energy with the same transition time. This renders the power supply more complex.

BRIEF SUMMARY OF THE INVENTION

The invention relates to a high voltage power supply for an X-ray tube which switches rapidly from one voltage to another and which is recuperative without losses, not requiring any additional device(s) to dissipate/restore the energy from discharging/recharging the high voltage capacitor (including the power supply cable).

In this way, according to a first aspect, the invention relates to an electrical power supply of an X-ray tube comprising a high voltage generation device configured to transmit a high voltage to the X-ray tube comprising: a primary capacitor; at least one voltage source configured to supply the primary capacitor; an energy storage device comprising an auxiliary capacitor configured to receive from the primary capacitor a quantity of energy and to return said energy to the primary capacitor; a control device arranged between the generation device and the storage device, the generation, storage and control devices being connected in series, the control device being capable of connecting or isolating the storage device from the generation device such that the X-ray tube is powered by a variable high voltage very rapidly between a first high voltage and a second high voltage.

The electrical power supply according to the first aspect of the invention may also optionally comprise at least one of the following features:

- the control device comprises a first assembly, a second assembly each formed by a switch mounted in anti-parallel with a diode;
- the auxiliary capacitor is dependent on the primary capacitor such that in operation: the energy between the generation device and the storage device is conserved and the load between the generation device and the storage device is conserved;
- the control device comprises an inductor forming with the primary and auxiliary capacitors a serial resonant circuit, the inductor being arranged between the two assemblies;
- the control device comprises a transformer connected between the two assemblies;
- the voltage source is a DC high voltage source capable of supplying a first high voltage and a second high voltage;
- the voltage source consists of a first DC high voltage source capable of supplying a first high voltage or a zero voltage and a second DC high voltage source capable of supplying a second high voltage added in operation in series with the first high voltage source; and
- the energy storage device also comprises a switch and a DC, variable, low-output power supply source, configured to set the ratio between the power supply voltages of the tube.

According to a second aspect, the invention relates to an X-ray tube power supply process by means of an X-ray tube power supply according to any of the above claims during which: the primary capacitor is charged by means of the DC high voltage source supplying a first high voltage and the assemblies are positioned such that the current only flows via the generation device, the X-ray tube being powered by a first high voltage; the primary capacitor is discharged via the storage device by positioning the assemblies such that the current flows from the generation device to the storage device; the assembly formed by the switch and the diode is positioned so as to isolate the storage device from the generation device so that the tube is powered by a first high voltage or a second high voltage according to the charging or discharging of the capacitors; the primary capacitor is recharged from the storage device by positioning the assemblies such that the current flows from the storage device to the primary capacitor of the generation device.

According to a third and final aspect, the invention relates to an X-ray radiological imaging system comprising a power supply for an X-ray tube according to the first aspect of the invention.

BRIEF DESCRIPTION OF THE SEVERAL VIEWS OF THE DRAWINGS

Other features and advantages of the invention will emerge from the following description which is purely illustrative and non-limitative, and which should be read with reference to the appended figures wherein.

DETAILED DESCRIPTION OF THE INVENTION

Figure 1:
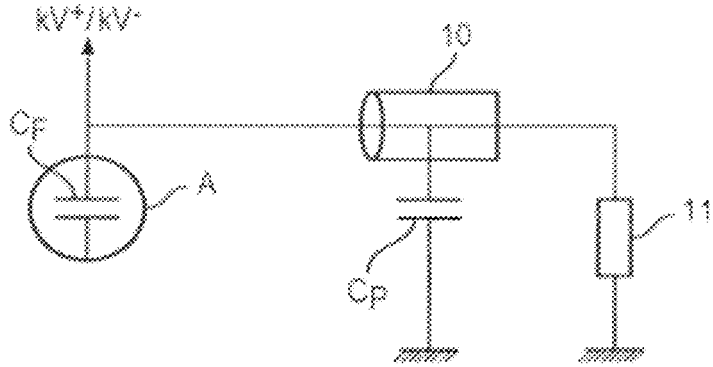
FIG. 1 illustrates a high voltage cable.
Figure 2:
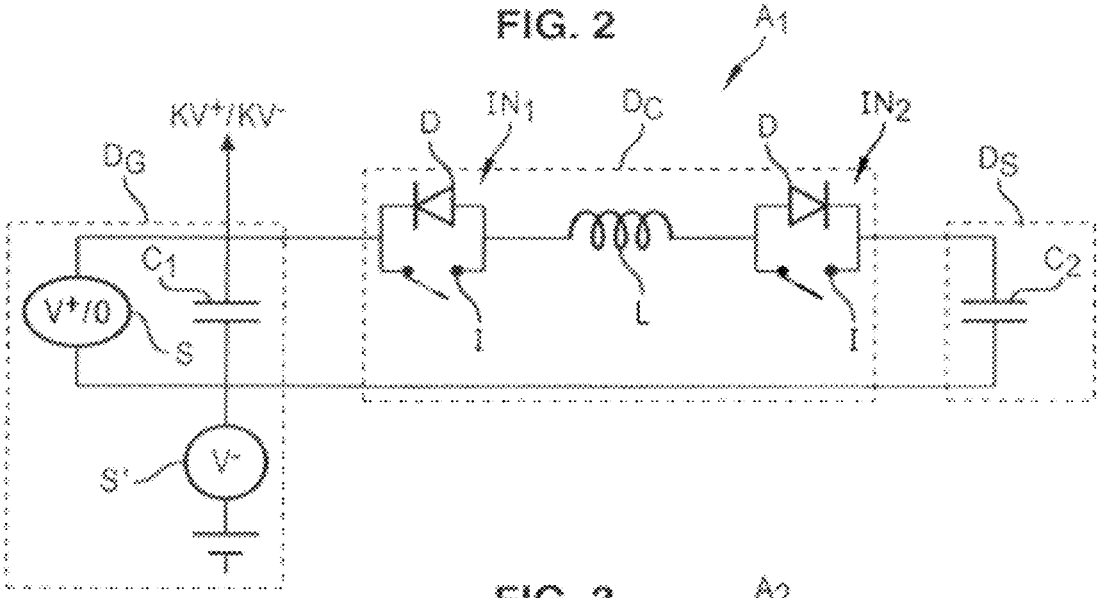
FIG. 2 illustrates a first embodiment of a power supply according to the invention.
Figure 3:
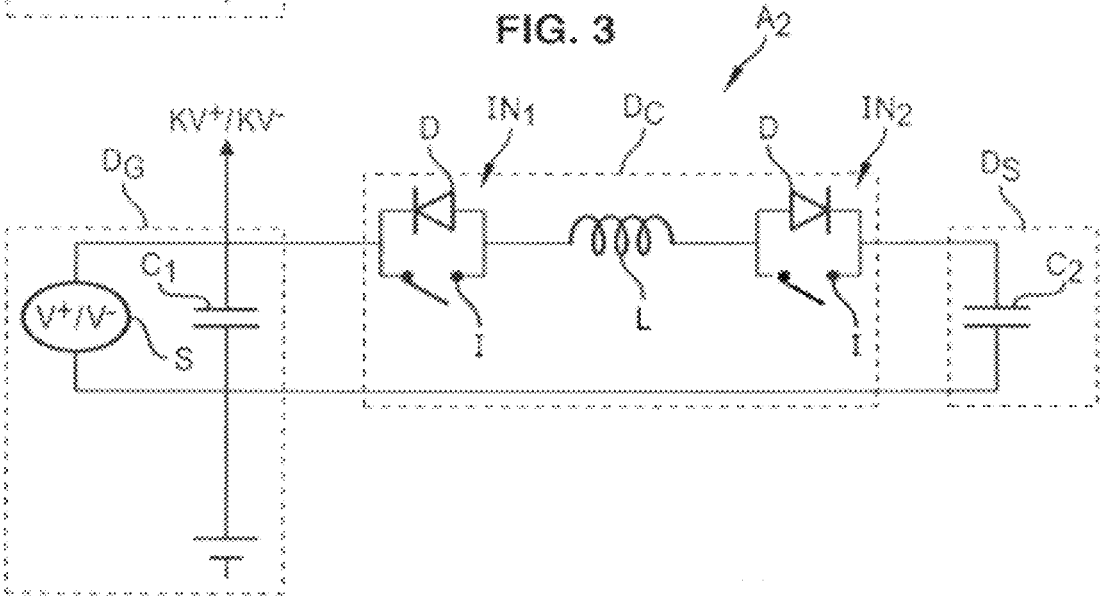
FIG. 3 illustrates a second embodiment of a power supply according to the invention.
Figure 4:
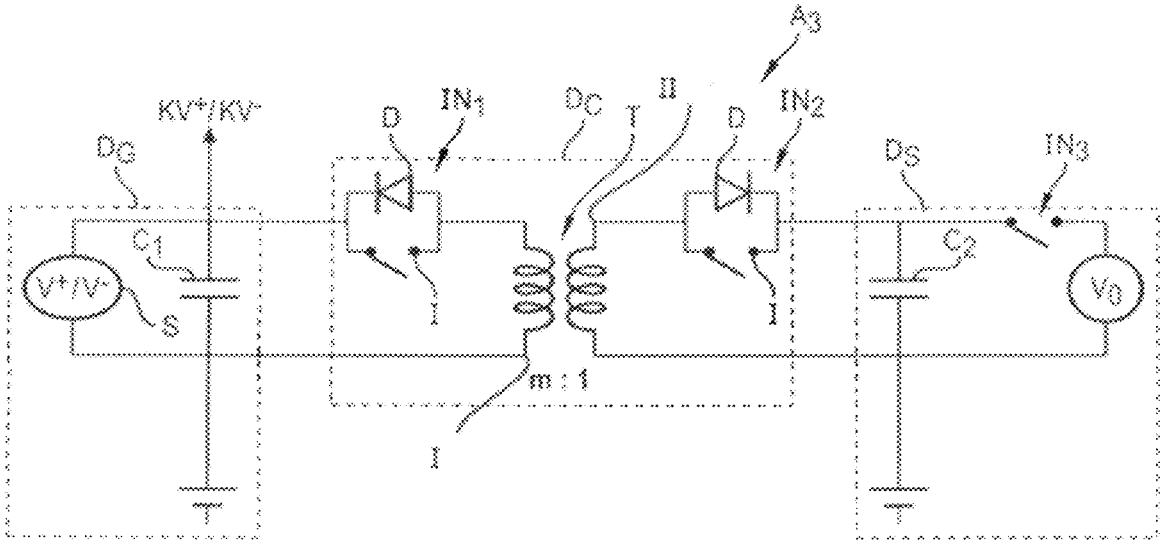
FIG. 4 illustrates a first embodiment of a power supply according to the invention.

FIGS. 2 to 4 illustrate different embodiments of an X-ray tube electrical power supply.

In each embodiment, the electrical power supply consists of three devices.

A high voltage generation device $D_G$ configured to transmit a high voltage to the X-ray tube, an energy storage device $D_S$ configured to store the energy from the high voltage generation device and return the stored energy to the high voltage generation device $D_G$ and a control device capable of connecting or isolating the storage device $D_S$ from the generation device $D_G$ such that the X-ray tube is powered by a variable high voltage very rapidly between a first high voltage $kV^+$ and a second high voltage $kV^-$.

Each embodiment makes it possible to switch from a first high voltage $kV^+$ to a second high voltage $kV^-$ without dissipation of energy.

Each embodiment is described more specifically below.

First Embodiment

In FIG. 2, a first embodiment of an electrical power supply $A_1$ of an X-ray tube is represented.

The generation device $D_G$ comprises a primary capacitor $C_1$ and an assembly formed by a first DC high voltage source S capable of switching from a voltage ($V^+$–$V^-$) volts to 0 volt and a second high voltage source S' capable of generating a second voltage $V^-$ volts. Said sources S and S' are one-way sources in terms of current, simple and conventional in terms of power electronics according to the prior art.

The first source S is coupled with the second source S' which is in turn coupled with the ground (or conversely). The energy storage device $D_S$ comprises an auxiliary capacitor $C_2$.

The auxiliary capacitor $C_2$ is coupled with the second high voltage source S'.

The control device comprises a first assembly $I_{N1}$ and a second assembly $I_{N2}$, each consisting of a controlled one-way switch I (conventional component such as transistor, thyristor, etc.) associated with a diode D mounted in anti-parallel with the switch I.

The assemblies $I_{N1}$ and $I_{N2}$ are controlled to enable the exchange of the loads and currents in both directions between the generation device $D_G$ coupled with the tube and the storage device $D_S$.

The control device $D_C$ comprises an inductor L arranged between the two assemblies $I_{N1}$ and $I_{N2}$.

The primary capacitor $C_1$ and auxiliary capacitor $C_2$ and the inductor L are connected in series when the switches $I_{N1}$ and $I_{N2}$ are conducting and therefore form a serial resonant circuit LC, wherein:

$$\text{Half-Period} = \Pi\sqrt{L\frac{C_1 \cdot C_2}{C_1 + C_2}} \qquad \text{(Equation 1)}$$

The voltage supplied by said electrical power supply $A_1$ varies between kV– Volts and kV+ Volts, for example between 100 and 200 kV (industrial X-ray generator) (or 80 kV and 160 kV (medical X-ray generators, etc.), the voltages of the sources S and S' being adjusted accordingly).

For switching to take place, both sources S and S' supply from 0 to 100 kV and +100 kV, respectively.

According to the position of the switches I of the assemblies $I_{N1}$, $I_{N2}$, the current flows in either direction and the voltage supplied by the source S is added to the voltage supplied by the second source S' such that the electrical power supply voltage of the X-ray tube can switch from 100 kV to 200 kV.

In this embodiment, the auxiliary capacitor $C_2$ acts as an energy reservoir.

Indeed, the primary capacitor $C_1$, according to the position of the switch I of the first assembly $I_{N1}$, is discharged in the auxiliary capacitor $C_2$ which stores the energy from the primary capacitor $C_1$. The auxiliary capacitor $C_2$ returns the energy to $C_1$ when the switch I of the assembly $I_{N2}$ is closed.

Due to the resonant circuit, the switches are closed and opened at zero current, therefore with no losses. In this way, there is no additional energy lost during the switching from one voltage to another.

Second Embodiment

In FIG. 3, a second embodiment of an electrical power supply $A_2$ of an X-ray tube is represented.

This embodiment differs from the first embodiment in that the generation device $D_G$ comprises a single DC high voltage source S, capable of switching from a first voltage $V^+$ volts to a second high voltage $V^-$ volts.

The energy storage device $D_S$ and the control device are identical to those in the first embodiment.

The voltage supplied by said electrical power supply varies between $kV^-$ volts and $kV^+$ volts for example between 100 and 200 kV.

The operation of said electrical power supply $A_2$ is identical to the electrical power supply $A_1$.

In this embodiment, the primary capacitor $C_1$ is charged and discharged partially between $V^+$ and $V^-$ in the auxiliary capacitor $C_2$, which varies between 0 and a non-zero voltage.

The auxiliary capacitor $C_2$ is calculated as a function of $C_1$, $V^+$ and $V^-$ to act as an energy reservoir, the energy accumulated during the charging of the capacitor $C_1$, being entirely restored when the auxiliary capacitor $C_2$ is discharged such that the electrical power supply voltage of the X-ray tube can switch from 100 kV to 200 kV.

The design of the capacitors complies with energy conservation and load conservation principles. According to the energy conversation and load conservation principle, this gives:

$$\begin{matrix} C_1((V_1^+)^2 - (V_1^-)^2) = C_2(V_2)^2 \\ C_1(V_1^+ - V_1^-) = C_2V_2 \end{matrix} \Rightarrow \begin{cases} V_2 = V_1^+ + V_1^- \\ C_2 = \dfrac{V_1^+ - V_1^-}{V_1^+ + V_1^-}C_1 \end{cases} \quad \text{(Equation 2)}$$

where $V_1^+$ and $V_1^-$ are, respectively, the maximum and minimum voltages at the terminals of the primary capacitor $C_1$ and $V_2$ is the voltage at the terminals of the auxiliary capacitor $C_2$. Note that $V_1^+$ and $V_1^-$ are equivalent to the voltages $V^+$ and $V^-$ supplied by the electrical power supply source S.

Consequently, if the electrical power supply switches from 100 kV to 200 kV, this gives $V_2$=300 kV and $$C_2 = \frac{1}{3}C_1.$$

Components withstanding such voltage values are feasible in a complex manner by placing components of reasonable voltages in series.

Third Embodiment

This embodiment makes it possible to simplify the implementation of the second assembly $I_{N2}$ and the auxiliary capacitor $C_2$ of the second embodiment.

In FIG. 4, the general principle of said third embodiment of the electrical power supply $A_3$ of an X-ray tube is represented.

In said embodiment, a transformer T is inserted between the two assemblies $I_{N1}$, $I_{N2}$ of the control device $D_C$.

The primary $I^{aire}$ of the transformer T is coupled with the first assembly $I_{N1}$ and the secondary $II^{aire}$ of the transformer T is coupled with the second assembly $I_{N2}$.

The transformer T has a transformation ratio selected to obtain a low voltage at the secondary. The components of the storage device $D_S$ and control device $D_C$ (components $I_{N1}$, $I_{N2}$, $C_2$ and the source $V_0$) therefore become low voltage or current or easily feasible and controllable components.

The transformer T is also designed so that the leakage inductor thereof forms the resonant inductor L of the previous embodiment.

Additionally, said electrical power supply $A_3$ may comprise a voltage source $V_0$ connected in parallel with the auxiliary capacitor $C_2$.

The implementation of an additional source $V_0$ makes it possible to provide flexibility on the choice of the values $V_+$ and $V^-$, about a given ratio, typically for example in medical CT, the pairs $V^+$ and $V^-$ are (70-140), (80-140), (70-150), (80-150) or (70-120).

The design of the capacitors complies with energy conservation and load conservation principles.

According to the energy conservation and load conservation principle, this gives:

$$\begin{matrix} C_1((V_1^+)^2 - (V_1^-)^2) = C_2(V_2)^2 \\ Q_1 = \dfrac{Q_2}{m} \Rightarrow C_1(V_1^+ - V_1^-) = \dfrac{1}{m}C_2V_2 \end{matrix} \Rightarrow \begin{cases} V_2 = \dfrac{V_1^+ + V_1^-}{m} \\ C_2 = m^2\dfrac{V_1^+ - V_1^-}{V_1^+ + V_1^-}C_1 \end{cases} \quad \text{(Equation 3)}$$

where $V_1^+$ and $V_1^-$ are, respectively, the maximum and minimum voltages at the terminals of the primary capacitor $C_1$ and $V_2$ is the voltage at the terminals of the auxiliary capacitor $C_2$ where $Q_1$ and Q2 are in fact $\Delta Q_1=C_1(V_1^+-V_1^-)$ and $\Delta Q_2=\Delta Q_1.m=C_2(V_2-0)$, m is the ratio of the primary voltage (high voltage) to secondary voltage (low voltage) of the transformer T.

Note that $V_1^+$ and $V_1^-$ are equivalent to the voltages $V^+$ and $V^-$ supplied by the power supply source S.

Consequently, if the power supply switches from 100 kV to 200 kV, this gives where m=300 for example, $V_2$=1 kV.

In this embodiment, the transformer T makes it possible to have a low voltage stage and a high voltage stage at either end of the primary $I^{aire}$ and the secondary $II^{aire}$.

Figure 5:
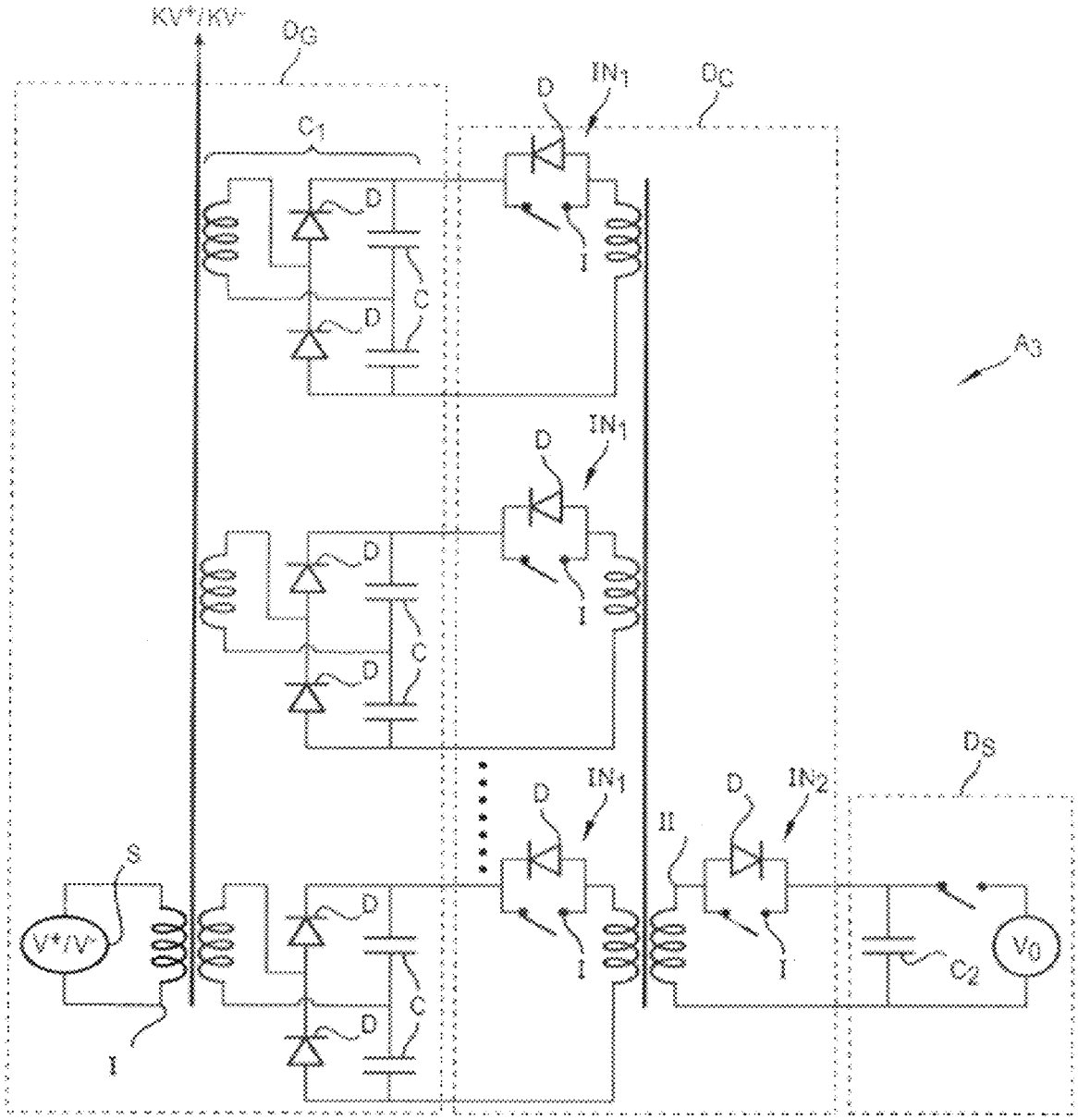
FIG. 5 illustrates an alternative to the third embodiment.

In FIG. 5, an alternative to said third embodiment of a electrical power supply $A_3$ of an X-ray tube is represented.

In this case, the primary capacitor $C_1$ is formed by a plurality of capacitors C mounted in series. This is quasi-natural as n capacitors C in series are equivalent to a single capacitor having a value C/n. Moreover, this is how the high voltage capacitors are produced.

FIG. 5 illustrates a stage voltage doubling assembly, with two diodes and two capacitors in series. It would have been possible to use a non-doubling assembly with four diodes (two diodes fitted instead of the two capacitors) and a single capacitor, replacing the two capacitors in series in FIG. 5.

The most common embodiment of the high voltage generators is to generate with n blocks of the fractions of the high voltage HT/n, which are all equal, and are placed in series as in FIG. 5, and therefore, the capacitors are in series, equal and all charged at the same voltage.

Another embodiment of the high voltage generators consists of generating an AC medium voltage, which is multiplied by diode-capacitor assemblies. This is generally carried out for low outputs, less than the outputs required for a medical or industrial CT application. With the multipliers, capacitors are also in series, but with voltages which are not all equal. The invention is still applicable but with a result of lower quality, but this case is not applicable to a CT application.

Indeed, besides the use of the transformer T which makes it possible to obtain a low voltage stage and therefore a low voltage auxiliary capacitor $C_2$, the specific architecture applied for the capacitor $C_1$ makes it possible to implement a capacitor $C_1$ and low voltage components.

In this way, in this embodiment, the capacitors $C_1$, $C_2$ are both low voltage which makes it possible to use conventional components (transistors and diodes from one to a few kV).

In operation, the electrical power supply $A_4$ supplies a voltage between 100 and 200 kV depending on whether the primary capacitor $C_1$ is charged or discharged.

It should be noted that, in this embodiment of the electrical power supply, the primary capacitor $C_1$ is charged and discharged partially via the auxiliary capacitor $C_2$.

Operation of the Power Supply

In FIGS. 6*a*, 6*b*, 6*c*, 6*d*, and 6*e*, a switching cycle from a first voltage equal to 100 kV to a second voltage equal to 200 kV supplied by the electrical power supply voltage $A_3$ according to the third embodiment is represented. FIG. 6*f* illustrates the switching cycle.

Figure 7:
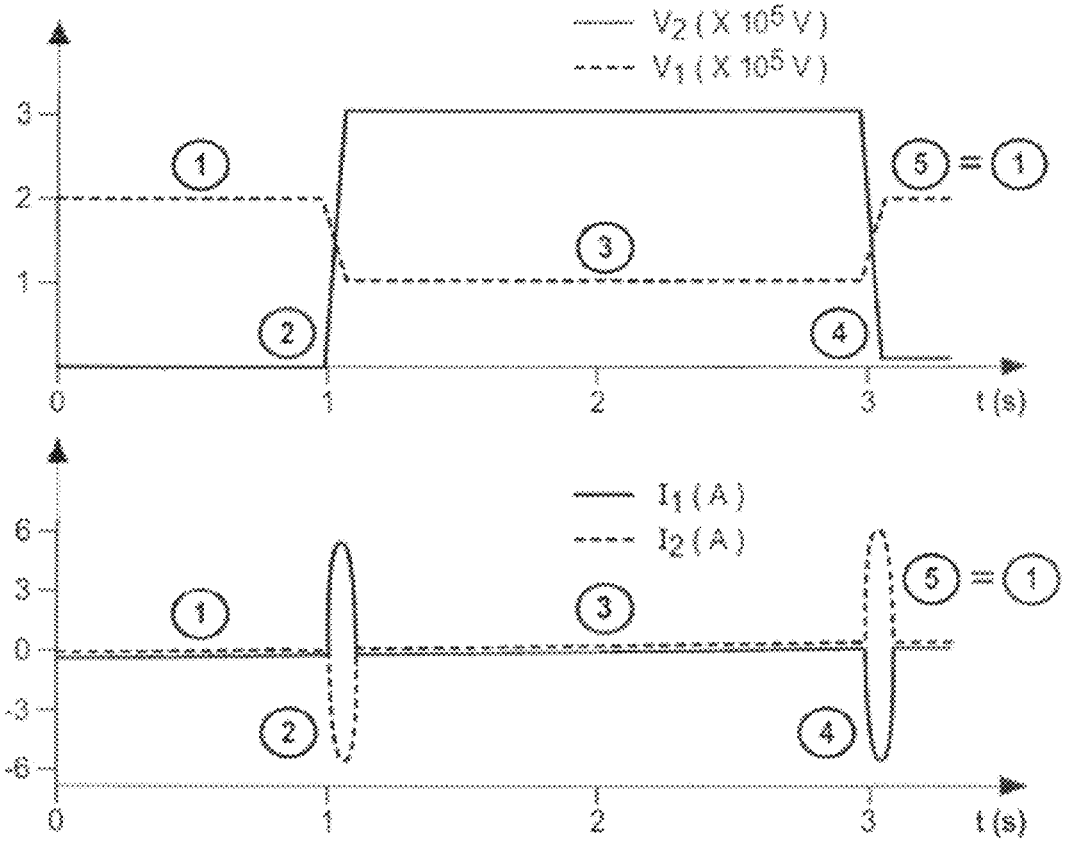
FIG. 7 illustrates the voltages and currents at the terminals of the primary and auxiliary capacitors of an X-ray tube according to the third embodiment of the invention.

To explain said switching cycle, the starting point is a state $E_1$ where the primary capacitor $C_1$ is charged and the voltage $V_i$ at the terminal of said capacitor is equal to $V_1$=200 kV (see part FIG. 7).

At this stage, when the electrical power supply source S supplies 200 kV, the voltage $V_2$ and the capacity at the terminals of the auxiliary capacitor $C_2$ is zero (see part 1 of FIG. 7).

Figure 6A:
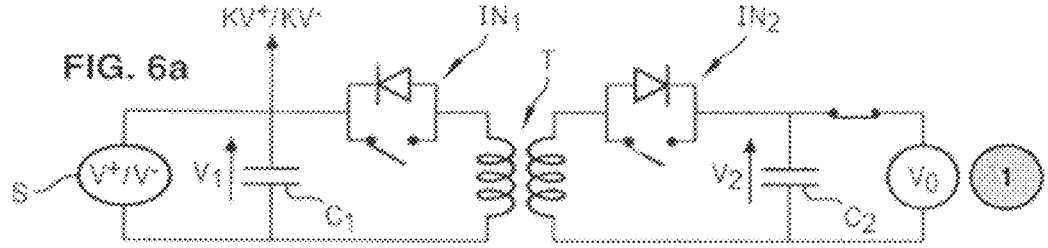
FIGS. 6*a*, 6*b*, 6*c*, 6*d*, 6*e*, and 6*f* illustrate the switching from a first voltage to a second voltage using an X-ray tube power supply according to the third embodiment of the invention.
Figure 6B:
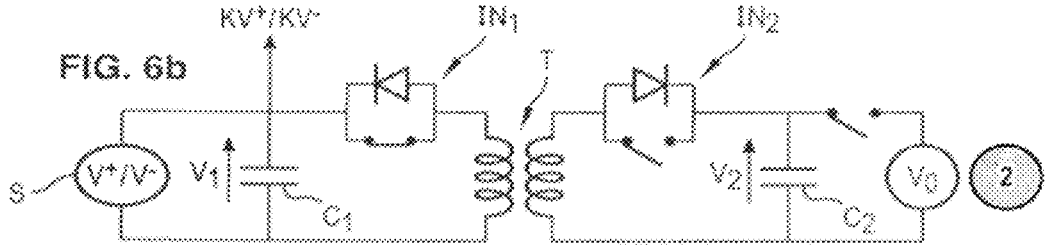
Figure 6C:
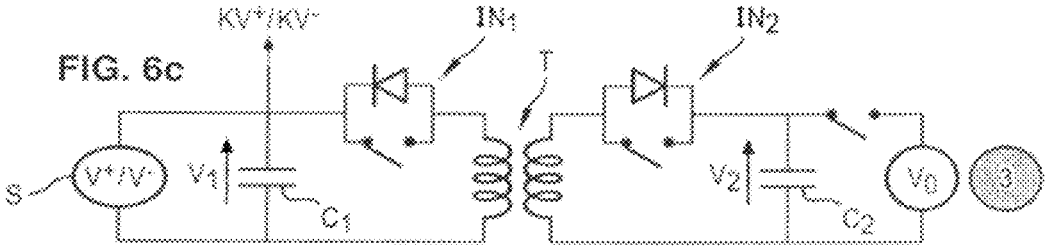
Figure 6D:
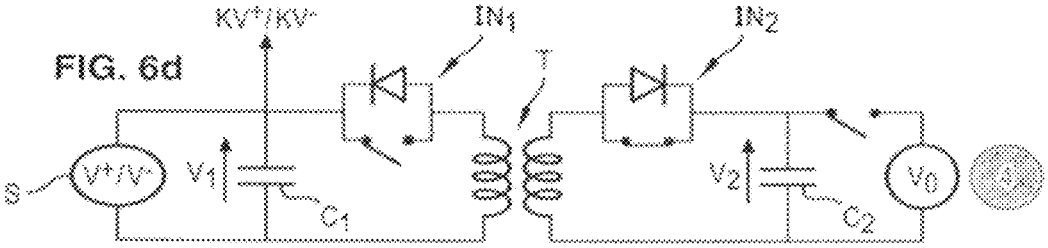
Figure 6E:
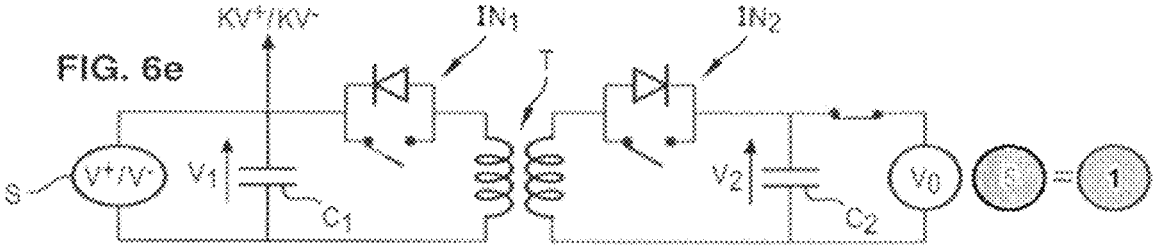
Figure 6F:
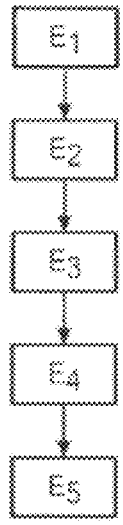

As illustrated in FIG. 6*a*, both switches I of the assemblies $I_{N1}$ $I_{N2}$ of the control device $D_C$ are open such that the generation device $D_G$ and storage device $D_S$ are isolated with respect to each other.

Once the primary capacitor C1 is charged, $E_2$ is closed, the capacitor $C_1$ will be discharged in the storage device and therefore, at the same time, the auxiliary capacitor $C_2$ will be charged. Note that the additional source $V_0$ will enable more rapid charging of the auxiliary capacitor $C_2$.

Once the primary capacitor has been discharged, $E_3$ all the switches of the assemblies are opened such that, as described above, the generation and storage devices are isolated with respect to each other.

The effect is that the electrical power supply $A_3$ has switched from the first voltage to the second voltage, i.e. from 100 kV to 200 kV (see part 3 of FIG. 7).

When it is desired to switch from the second voltage to the first voltage, $E_4$ the switch of the assembly coupled with the secondary of the transformer T is opened such that the auxiliary capacitor $C_2$ is discharged from the storage device $D_S$ to the generation device $D_G$ (see part 4 of FIG. 7).

Once the auxiliary capacitor $C_2$ has been discharged, $E_5$ all the switches of the electrical power supply are opened such that current does not flow between the generation device $D_G$ and the storage device $D_S$. The main effect is that the electrical power supply $A_3$ has switched from the second voltage to the first voltage, i.e. from 200 kV to 100 kV (see part 5 of FIG. 7).

What is claimed is:

1. An electrical power supply for an X-ray tube, the electrical power supply comprising:

a high voltage generation device ($D_G$) configured to transmit a high voltage to the X-ray tube, the high voltage generation device ($D_G$ comprising:

a primary capacitor ($C_1$); and at least one voltage source (S) configured to supply the primary capacitor ($C_1$);

an energy storage device ($D_S$) comprising:

an auxiliary capacitor ($C_2$) configured to receive from the primary capacitor ($C_1$) a quantity of energy and to return said energy to the primary capacitor ($C_1$); and a control device ($D_C$) arranged between the high voltage generation device ($D_G$) and the energy storage device ($D_S$), the high voltage generation device ($D_G$), the energy storage device ($D_S$) and the control device ($D_C$) being connected in series, the control device ($D_C$) configured to connect or isolate the energy storage device ($D_S$) from the high voltage generation device ($D_G$) such that the X-ray tube is powered by a variable high voltage between a first high voltage ($kV^{30}$ ) and a second high voltage ($kV^{31}$ ).

2. The electrical power supply of claim 1, wherein the control device ($D_C$) comprises a first assembly ($I_{N1}$), a second assembly ($I_{N2}$,) each formed by a switch (I) mounted in anti-parallel with a diode (D).

3. The electrical power supply of claim 1, wherein the auxiliary capacitor ($C_2$) is dependent on the primary capacitor ($C_1$) such that in operation:

the energy between the high voltage generation device ($D_G$) and the energy storage device ($D_S$) is conserved; and that the load between the high voltage generation device ($D_G$) and the energy storage device ($D_S$) is conserved.

4. The electrical power supply of claim 2, wherein the control device ($D_C$) comprises an inductor (L) forming with the primary ($C_1$) and auxiliary ($C_2$) capacitors a serial resonant circuit, the inductor being arranged between the two assemblies ($I_{N1}$, $I_{N2}$).

5. The electrical power supply of claim 2, wherein the control device ($D_C$) comprises a transformer (T) connected between the two assemblies ($I_{N1}$, $I_{N2}$).

6. The electrical power supply of claim 1, wherein the voltage source (S) is a DC high voltage source configured to supply a first high voltage ($V^+$) and a second high voltage ($V^-$).

7. The electrical power supply of claim 1, wherein the voltage source consists of a first DC high voltage source (S) configured to supply a first high voltage ($V^+$) or a zero voltage and a second DC high voltage source (S') capable of supplying a second high voltage (V) added in operation in series with the first high voltage source (S).

8. The electrical power supply of claim 2, wherein the energy storage device also comprises a switch ($I_{N3}$) and a DC, variable, low-output power supply source ($V_0$) configured to set the ratio between the power supply voltages of the tube.

9. An X-ray radiological imaging system, comprising:

an X-ray tube; and an electrical power supply for the X-ray tube, wherein the electrical power supply comprises:

a high voltage generation device ($D_G$) configured to transmit a high voltage to the X-ray tube, the high voltage generation device ($D_G$) comprising:

a primary capacitor ($C_1$); and at least one voltage source (S) configured to supply the primary capacitor ($C_1$);

an energy storage device ($D_S$) comprising:

an auxiliary capacitor ($C_2$) configured to receive from the primary capacitor ($C_1$) a quantity of energy and to return said energy to the primary capacitor ($C_1$); and a control device ($D_C$) arranged between the high voltage generation device ($D_G$) and the energy storage device ($D_S$), the high voltage generation device ($D(_G$), the energy storage device ($D_S$) and the control device ($D_C$) being connected in series, the control device ($D_C$) configured to connect or isolate the energy storage device ($D_S$) from the high voltage generation device ($D_G$) such that the X-ray tube is powered by a variable high voltage between a first high voltage ($kV^{30}$ ) and a second high voltage ($kV^-$).

* * * * *

UNITED STATES PATENT AND TRADEMARK OFFICE

CERTIFICATE OF CORRECTION

PATENT NO. : 8,189,741 B2
APPLICATION NO. : 12/694301
DATED : May 29, 2012
INVENTOR(S) : Ernest et al.

It is certified that error appears in the above-identified patent and that said Letters Patent is hereby corrected as shown below:

In Column 4, Line 33, delete "kV- Volts and kV+" and insert -- $kV^-$ Volts and $kV^+$ --, therefor.

In Column 5, Line 62, delete "$V_+$" and insert -- $V^+$ --, therefor.

In Column 6, Line 18, delete "Q2" and insert -- $Q_2$ --, therefor.

In Column 7, Line 12, delete "$V_i$" and insert -- $V_1$ --, therefor.

in Column 7, Line 21, delete "C1" and insert -- $C_1$ --, therefor.

In Column 7, Line 50, in Claim 1, delete "($D_G$" and insert -- ($D_G$) --, therefor.

In Column 8, Line 2, in Claim 1, delete "($kV^{30}$)" and insert -- ($kV^+$) --, therefor.

In Column 8, Line 3, in Claim 1, delete "($kV^{31}$)." and insert -- ($kV^-$). --, therefor.

In Column 8, Line 55, in Claim 9, delete "($D_{(G)}$)," and insert -- ($D_G$), --, therefor.

In Column 8, Line 62, in Claim 9, delete "($kV^{30}$)" and insert -- ($kV^+$) --, therefor.

Signed and Sealed this
Twenty-seventh Day of November, 2012

David J. Kappos

David J. Kappos
*Director of the United States Patent and Trademark Office*